United States Patent [19]

Lautenschläger

[11] Patent Number: 4,622,716

[45] Date of Patent: Nov. 18, 1986

[54] DOOR-RELATED HINGE PART FOR A CABINET HINGE

[75] Inventor: Gerhard Lautenschläger, Brensbach, Fed. Rep. of Germany

[73] Assignee: Karl Lautenschlager KG Mobelbeschlagfabrik, Reinheim, Fed. Rep. of Germany

[21] Appl. No.: 771,631

[22] Filed: Aug. 30, 1985

[30] Foreign Application Priority Data

Aug. 31, 1984 [DE] Fed. Rep. of Germany ..... 3431999

[51] Int. Cl.[4] ..... E05D 5/02

[52] U.S. Cl. ..... 16/384

[58] Field of Search ..... 16/384, 370, 382, DIG. 40

[56] References Cited

U.S. PATENT DOCUMENTS 4,069,549 1/1978 Zernig ..... 16/384
4,270,240 1/1981 Zernig ..... 16/382

FOREIGN PATENT DOCUMENTS 2036565 5/1971 Fed. Rep. of Germany ..... 16/384
2510259 9/1976 Fed. Rep. of Germany ..... 16/370
2606181 8/1977 Fed. Rep. of Germany ..... 11/384
2153426 7/1980 Fed. Rep. of Germany ..... 16/382

*Primary Examiner*—Gene P. Crosby

[57] ABSTRACT

The door-related part of a cabinet hinge is in the form of a cup insert having a cup part which can be sunk flush into a recess in the back of a door. On the upper, free margin of the cup part a fastening flange integral therewith extends symmetrically with the longitudinal central axis on opposite sides of the latter, against the back of the door. From the bottom of the fastening flange projects a fastening stud engaged in a bore in the door adjacent the recess. This fastening stud is provided adjacent its free end with a knife-edged projection. Due to a special configuration, the fastening stud can be introduced into its corresponding bore in a canted position when the cup is installed. By a final rocking of the cup from the canted position in which it was inserted to the intended installed position, the knife-edged projection is forced into the wall of the bore receiving the fastening stud and positively locks the fastening stud against withdrawal from the bore.

9 Claims, 3 Drawing Figures

DOOR-RELATED HINGE PART FOR A CABINET HINGE

BACKGROUND OF THE INVENTION

The invention relates to a door-related hinge part for installing cabinet hinges, in the form of an insert cup having a cup portion which can be set in a mortise in the back of a door and is integral with a mounting flange extending from its upper, free edge symmetrically with the longitudinal central axis of the cup part over the back of the door, in contact with the latter, from whose bottom a mounting stud projects substantially at right angles and engages a bore adjacent the mortise in the door.

The door-related parts of modern articulated hinges by which doors are hung on a corresponding cabinet case such that the entire hinge is invisible when the door is closed, are today mostly in the form of insert cups that can be fastened or driven flush into a recess or mortise in the back of the door, and the door ends of the links of the articulated hinges are pivoted within them. These insert cups have each a cup part which can be inserted into the recess in the door back, and from their upper margin a flange resting against the door back projects radially, thus determining the depth to which the cup is set in the recess. This flange in many cases serves simultaneously as the fastening flange, in that it is made large enough to be provided with one or two holes through which the threaded shaft of a mounting screw can be driven into the door. Alternatively, mounting studs consisting, as a rule, of plastic, are provided on the bottom of the fastening flange, which can be pressed or driven into undersized fastening bores in the back of the door, or they are made so as to be expanded in the manner of expansion fasteners so that they can be inserted without forcing into the fastening bores and can then be locked in the bores by expansion.

In any case, the fastening studs must not be made of an absolutely rigid material, i.e., they must be slightly elastic in order to have a reliable and long-lasting anchorage even in the brittle chipboard materials used tody in furniture construction.

Therefore, the fastening studs are manufactured of an appropriately elastic plastic material, even when the actual cup is made otherwise entirely or partially of metal. The fastening studs must therefore be manufactured separately and affixed to the metal fastening studs. It is disadvantageous in this case that the oversized fastening studs driven or pressed into the associated fastening bores do not, as a rule, permit the door-related hinge part to be dismounted without damaging the fastening bores, because, to increase the holding power of the fastening studs, the latter are provided with circumferential ridges of sawtooth-like cross section. The door-related hinge parts provided with expansion-type fastening studs, however, are, as a rule, dismountable, but at the same time they are relatively expensive to manufacture and their installation and removal--at least when two expansion-type fastening studs are provided--are also time-consuming. In addition, in the case of furniture in kit form or of the take-apart variety, which are sold in knocked-down and packed condition, hinges are, insofar as possible, not preinstalled, but packed separately so as to permit the doors to be laid flat with the cabinet walls in a very compact package, and also to prevent the cabinet parts from being damaged by protruding hinge parts. Door-related hinge parts with mounting studs that can be driven or pressed in place, however, require suitable jigs or presses for assembly, and therefore are by no means usable on such knocked-down furniture to be assembled by the purchaser at home.

It is therefore the object of the invention to create a door-related hinge part for modern articulated hinges, which can be made easily and at low cost, and which can be installed quickly and simply without special aids, even by laypeople, can withstand heavy loads after installation, and can be taken apart again without damage to the associated recess and/or fastening bore.

THE INVENTION

Setting out from a door-related hinge part of the kind mentioned above, this object is accomplished by the invention by the fact that the fastening stud, which is of substantially circular cross section in its portion immediately adjacent the bottom of the fastening flange, tapers slightly towards its free end on about half of its circumference, on its side facing the cup part, while its opposite side is defined by a semicylindrical surface; that the bottom of the fastening flange facing the door has in its portion bearing the fastening stud, a ramp surface beginning at a line running approximately centrally through the fastening stud in a plane at right angles to the directrix of the side of the fastening stud facing the cup part, and that, on the semicylindrical side of the fastening stud facing away from the cup part at least one radially projecting, knife-edged projection is provided. In spite of the radially projecting knife-edged projection at the free end, the fastening stud can nevertheless be inserted into a fastening bore in the door, which is provided at an appropriate distance from the recess for holding the cup part, by tilting the stud by the amount of slope of its tapered side facing the cup part. Then, when the stud is in the fully inserted state, the ramp surface on the bottom of the fastening flange will lie against the back of the door, while the rest of the fastening flange will be held away from the back of the door by the amount of the slope of the ramp surface. If then the fastening flange is pressed down to the fastening position in which it lies flat on the back of the door, the knife-edged projection on the end of the fastening stud will dig into the wall of the fastening bore and positively lock the fastening stud against extraction from this bore. That is to say, in contrast to the friction holding of an oversized stud in an undersized fastening bore, this fastening stud has a positive interlocking grip in the bore. Disassembly without damage to the bores is, of course, possible by reversing the procedure, i.e., by lifting and slightly rocking the fastening flange back to the stud introducing position and then lifting the door-related hinge part from the back of the door.

The knife-edged projection is best provided adjacent the free end of the fastening stud and extends over at least a portion of the semicylindrical side in the circumferential direction of the fastening stud, because thus the maximum radial distance is achieved between its crest and the stud and thus a correspondingly deep penetration of the projection into the wall of the bore is obtained.

Alternatively, two or more knife-edged projections can be provided at intervals in the direction of the central axis of the fastening stud, but then the height of the knife-edged projections must decrease beginning from the highest projection at the free end of the fastening stud, in order to be able to introduce the fastening stud into the corresponding fastening bore.

The circumferential wall of the cup part of the door-related hinge part is best beveled on the side diametrically opposite the fastening stud so as to match the fastening stud, so that, when the hinge part is set in the abovedescribed tilted position, the cup part will also be pressed into the associated recess.

After the introduction of the fastening stud into its corresponding bore and the introduction of the cup part into the recess, in order to be able to rock the fastening flange down into engagement with the back of the door and then hold it in this position, the configuration is preferably made such that the fastening stud projects from the bottom of the fastening flange at a lateral distance from the longitudinal central axis of the cup part, and that on the opposite side of the longitudinal central axis a hole is provided in the fastening flange for a fastening screw. By means of a fastening screw driven through this hole into the back of the door, the fastening flange is thus drawn into the proper fastening position, and then held in this position by the screw. If a so-called "chipboard screw" is used as the fastening screw, it is even possible to omit the drilling of a pilot hole into the back of the door in line with the hole in the flange.

The fastening stud with the fastening flange and the cup part is made, in a preferred embodiment of the invention, integrally from metal by the die-casting process, preferably from a zinc die-casting alloy (Zamak).

The invention is further explained in the following description of an embodiment in conjunction with the drawing.

SUMMARY DESCRIPTION OF THE DRAWING

FIG. 1 is a perspective view of a door-related hinge part for a four-pivot hinge, FIG. 2 is a front view of the door-related hinge part, seen in the direction of the arrow 2 in FIG. 1, and FIG. 3 is a side view of the door-related hinge part, seen in the direction of arrow 3 in FIG. 1.

DESCRIPTION OF A PREFERRED EMBODIMENT

Figure 1:
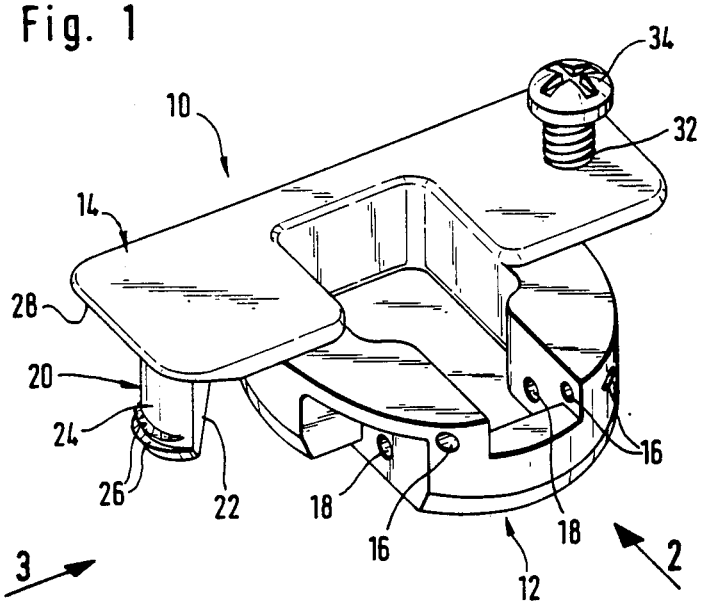

Let it be assumed that the door-related hinge part shown in the drawing and designated generally by the number 10 is intended for attaching a modern four-pivot hinge to a cabinet door, and accordingly is in the form of an insert cup commonly used in such hinges, which is composed of a cup part 12 which can be inserted into a mating recess or mortise in the back of the door, and a fastening flange 14 attached to its upper, free edge, which projects beyond the cup part 12 on opposite sides, in symmetry with its longitudinal central plane. The cup part 12 can therefore be inserted into the associated recess on the back of the door until the undersides of the laterally projecting parts of the fastening flange lie against the back of the door.

Bores 16 and 18 are provided in the circumferential wall of the cup part 2 for the pivotal mounting of the hinge links by which the hinge part 10 is coupled to the corresponding cabinet wall-related part of the hinge.

Figure 2:
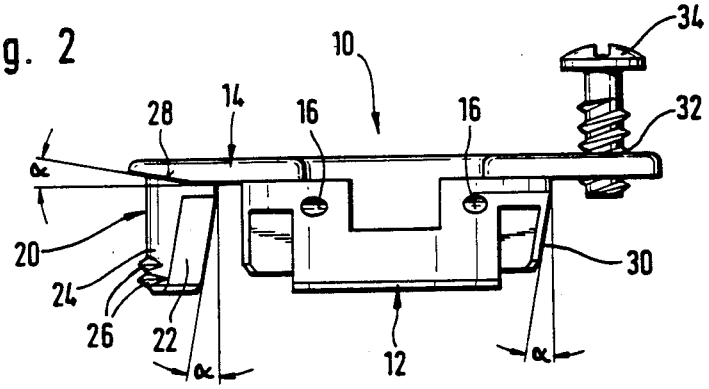
Figure 3:
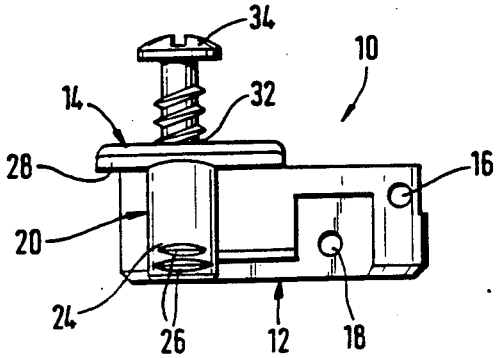

From the bottom of the fastening flange part that extends on the one side (the left side in FIGS. 1 and 2) there projects at approximately right angles a fastening stud 20 which is intended for engagement in a fastening bore provided at an appropriate distance from the recess for receiving the cup part 12 in the back of a door. At the same time the fastening stud 20 is to secure the cup part 12 not only against turning, but also against extraction from the associated recess. For this purpose the fastening stud 20, which is to be imagined as originally cylindrical, tapers on its side facing the cup part 12 over a relatively great portion of its length and approximately on half of its circumference towards its free end, the slope angle $\alpha$ amounting to, say, 10°, for example. The opposite side 24 of the fastening stud 20, i.e., the one facing away from the cup part 12, is still defined by the original cylindrical surface, i.e., it has an approximately semicylindrical shape. At the bottom end of the fastening stud 20, on this side 24 facing away from the cup part, there is provided a circumferentially running, knife-edged projection 26, which extends, let us say, over a portion of this semicylindrical side. In the area bearing the fastening stud 20, the doorfacing bottom of the fastening flange has a ramp surface 28 starting out from a line running centrally through the fastening stud 20, approximately parallel to the longitudinal central plane of the hinge part 10, i.e., it encloses with the remaining, planar bottom of the fastening flange 14 an angle $\alpha$, again of approximately 10°. It is now apparent that the door-related hinge part 10, in spite of the projection 26 that protrudes from its free end, can be introduced into a fastening bore in a door if the fastening stud is rocked by the angle $\alpha$, i.e., if the door-related part 10 is set at a slight angle. In order then to prevent the circumferential wall of the cup part 12, which itself is to be thought of as being originally cylindrical, from hanging up on the side opposite the fastening stud 20, at the edge of the recess in the door leaf, this circumferential wall is also beveled in the critical area 30 (FIG. 2) to match the fastening stud, i.e., also at the angle $\alpha$. It is clear, therefore, that the stud 24 and the cup part 12 can be inserted in the above-mentioned slanting position, into the associated fastening bore or recess, with the ramp surface 28 bearing against the back of the door. Then, by pressing against the section of the fastening flange 14 that is on the opposite side of the longitudinal central plane through the hinge part, the hinge part can be rocked to the intended fastening position in which the planar underside of the fastening flange 14 lies on the back of the door. At the same time the knife-like, sharpened projection 26 will penetrate into the wall of the corresponding fastening bore and lock itself positively in the indentation of complementary shape which it thus forms. The act of rocking the fastening flange down and locking it in the final fastening position is accomplished by means of a fastening screw 34, whose shaft is driven through a hole 32 into the back of the door, and which then by its head lying on the surface of the fastening flange or in a countersink in this fastening flange transmits the necessary holding force to the fastening flange. The fastening of the door-related hinge part 10 therefore ultimately requires only one fastening screw, although the cup itself is held positively on the opposite side by the fastening stud 20. Moreover, it is apparent that disassembly is performed by reversing the procedure described above, i.e., the fastening screw is backed out of the hole 32, and then the fastening flange is lifted on the hole side by the angle $\alpha$. This backs the projection 26 out of the indentation in the wall of the fastening bore and the door-related hinge part can be lifted away from the door.

The above-described door-related hinge part can be made integrally of metal, preferably by the die casting method from a suitable zinc alloy, although it is conceivable that it might also be manufactured from a sufficiently strong thermoplastic by injection molding. Although for reasons of manufacturing economy the integral production of the hinge part is preferred, it is, of course, also possible for the fastening stud to be made separately in special cases and fastened afterward to the fastening flange. These and other modifications can be realized within the scope of the idea of the invention. For example, it is also possible to provide, in addition to the sharpened projection 26 at the bottom free end of the fastening stud 20, one or two additional projections of the same kind at other levels, which then must have in each case a lower height than the next one closer to the free end, so as not to interfere with the introduction of the fastening stud into the corresponding fastening bore.

I claim:

1. A door-related hinge part for a cabinet hinge, comprising: an insert cup having a cup portion to be set in a mortise in a door, a mounting flange integral with and extending from an upper portion of the cup part on opposite sides with respect to a longitudinal central axis of the cup part, a fastening stud projecting substantially at right angles to said flange from a bottom portion thereof for engaging a bore adjacent the mortise in the door, said fastening stud having a substantially circular cross section in a portion immediately adjacent the bottom portion of the flange, then tapering slightly to a free end remote from the flange over about half of its circumference on the side thereof facing the cup part, while the opposite side of the stud defines a semicylindrical surface; the bottom portion of the mounting flange adjacent the fastening stud having a ramp surface beginning at a line running approximately centrally through the fastening stud in a plane at right angles to the directrix of the side of the fastening stud facing the cup part; and on the semicylindrical side of the fastening stud facing away from the cup part at least one radially projecting, knife-edged projection.

2. A door-related hinge part according to claim 1, wherein the at least one knife-edged projection is provided adjacent the free end of the fastening stud and extends over at least a portion of the semicylindrical surface in the circumferential direction of the fastening stud.

3. A door-related hinge part according to claim 1, comprising at least two knife-edged projections offset in the direction of the longitudinal central axis of the fastening stud adjacent the free end of the fastening stud, each projection extending over at least a portion of the semicylindrical surface, in the circumferential direction of the stud.

4. A door-related hinge part according to claim 3, wherein the height of the knife-edged projections diminishes from projection to projection beginning from the projection provided at the free end of the fastening stud furthest from the flange.

5. A door-related hinge part according to any one of claims 1 to 4, wherein the cup part is beveled on the side diametrically opposite the fastening stud to match the fastening stud.

6. A door-related hinge part according to any one of claims 1 to 4, wherein at a lateral distance from and on the opposite side of the longitudinal central axis of the cup part from the fastening stud a through-hole is provided in the mounting flange for a fastening screw.

7. A door-related hinge part according to claim 5, wherein at a lateral distance from and on the opposite side of the longitudinal central axis of the cup part from the fastening stud a through-hole is provided in the mounting flange for a fastening screw.

8. A door-related hinge part according to claim 1, wherein the fastening stud, mounting flange and the cup part form an integral pressure-cast metal element.

9. A door-related hinge part according to claim 8, wherein said metal is a zinc alloy.

* * * * *